US005927258A

United States Patent [19]

Clauss et al.

[11] Patent Number: 5,927,258

[45] Date of Patent: Jul. 27, 1999

[54] VENTING ARRANGEMENT WITH INTEGRATED OIL SEPARATOR FOR AN INTERNAL COMBUSTION ENGINE

[75] Inventors: Roland Clauss, Esslingen; Georg Leipner, Hochdorf; Willy Treyz, Neckartailfingen, all of Germany

[73] Assignee: Daimler-Benz A.G., Stuttgart, Germany

[21] Appl. No.: 09/015,467

[22] Filed: Jan. 29, 1998

[51] Int. Cl.[6] ..... F01M 13/00

[52] U.S. Cl. ..... 123/573; 123/572; 55/DIG. 19

[58] Field of Search ..... 123/572, 573, 123/574; 55/394, 385.3, DIG. 19

[56] References Cited

U.S. PATENT DOCUMENTS

| | | | |
|---|---|---|---|
| 4,453,525 | 6/1984 | DeBruler . | |
| 4,569,323 | 2/1986 | Okumura | 123/572 |
| 4,844,032 | 7/1989 | Groeger et al. . | |
| 4,958,613 | 9/1990 | Hiraoka et al. | 123/572 |
| 4,993,375 | 2/1991 | Akihiko | 123/90.38 |
| 5,069,192 | 12/1991 | Matsumoto et al. | 123/572 |

FOREIGN PATENT DOCUMENTS

| | | |
|---|---|---|
| 0 471 886 | 2/1992 | European Pat. Off. . |
| 31 52 747 | 1/1984 | Germany . |
| 37 01 587 | 11/1987 | Germany . |
| 37 13 210 | 11/1988 | Germany . |
| 2 310 688 | 9/1997 | United Kingdom . |

*Primary Examiner*—Henry C. Yuen
*Assistant Examiner*—Hai Huynh
*Attorney, Agent, or Firm*—Klaus J. Bach

[57] ABSTRACT

In a venting arrangement with integrated oil separator for venting gases from the crankcase of an internal combustion engine having a cylinder head with a cylinder head cover, the cylinder head cover includes integrally formed therewith a housing divided into a raw gas space receiving vent gases from the engine crankcase and having an exit opening directed toward the cylinder head and a purified gas space having an inlet opening disposed adjacent the exit opening of the raw gas space and both openings are disposed above a collection space which is formed in the cylinder head and in which the raw gas flow from the raw gas space is reversed and redirected into the purified gas space whereby the oil droplets are separated from the vent gas and collected in the collection space to be returned to the engine crankcase.

7 Claims, 4 Drawing Sheets

VENTING ARRANGEMENT WITH INTEGRATED OIL SEPARATOR FOR AN INTERNAL COMBUSTION ENGINE

BACKGROUND OF THE INVENTION

The invention relates to a venting arrangement with an integrated oil separator for venting the crankcase of an internal combustion engine, particularly a V-type engine. The venting arrangement comprises a housing consisting of a top and a bottom part and having an inlet for the venting gases exiting the crankcase and an outlet for the vent gases from which oil has been separated and which are supplied, by way of a connecting line, to the intake duct of the internal combustion engine.

Such a venting arrangement with an integrated oil separator is disclosed for example in D 37 13 210 C2. The venting arrangement and the oil separator are part of a housing which is provided with baffles and which is disposed in the V-space of the V-like arranged cylinder banks of the internal combustion engine. The housing comprises a top and a bottom part and has the shape of a pot. It consists of a plastic material. It includes baffles which are formed by fins extending from the housing top and bottom parts, the fins of one part being received between fins of the opposite part. Vent gases enter from the crankcase directly the pot-like housing and flow through the housing.

It is the object of the present invention to provide a venting arrangement with integrated oil separator in such a way that manufacture and assembly is facilitated and that the arrangement requires relatively little space on the engine, yet provides for a good crankcase venting effectiveness.

SUMMARY OF THE INVENTION

In a venting arrangement with integrated oil separator for venting gases from the crankcase of an internal combustion engine having a cylinder head with a cylinder head cover, the cylinder head cover includes integrally formed therewith a vent housing divided into a raw gas space receiving vent gases from the engine crankcase and having an exit opening directed toward the cylinder head and a purified gas space having an inlet opening disposed adjacent the exit opening of the raw gas space and both openings are disposed above a collection space which is formed in the cylinder head and in which the raw gas flow from the raw gas space is reversed and redirected into the purified gas space whereby the oil droplets are separated from the vent gas and collected in the collection space to be returned to the engine crankcase.

Advantageous embodiments are given in the various dependent claims.

Since the bottom part of the vent housing receiving the vent gases is part of the cylinder head cover, the manufacture of the vent housing is greatly simplified. In addition, weight is saved since a wall portion of the cylinder head cover at the same time serves as bottom part of the vent housing. The arrangement also saves space so that the auxiliary engine components normally arranged along the engine are not affected.

With the arrangement of the separating wall in the vent housing, the raw gas space and the clean gas space are spatially separated from each other in a simple manner.

Concerning the simplification of the manufacturing process, the raw gas discharge opening and the purified gas inlet opening and a cylinder head inlet opening extending over the two openings are preferably all disposed in a dividing plane formed between the cylinder head cover and the cylinder head.

With a narrow channel outlet for the raw gas the vent gases are accelerated and enter the cylinderhead inlet opening at relatively high speed.

The invention will become more readily apparent from the following description of an embodiment thereof on the basis of the accompanying drawings.

DESCRIPTION OF A PREFERRED EMBODIMENT

Figure 2:
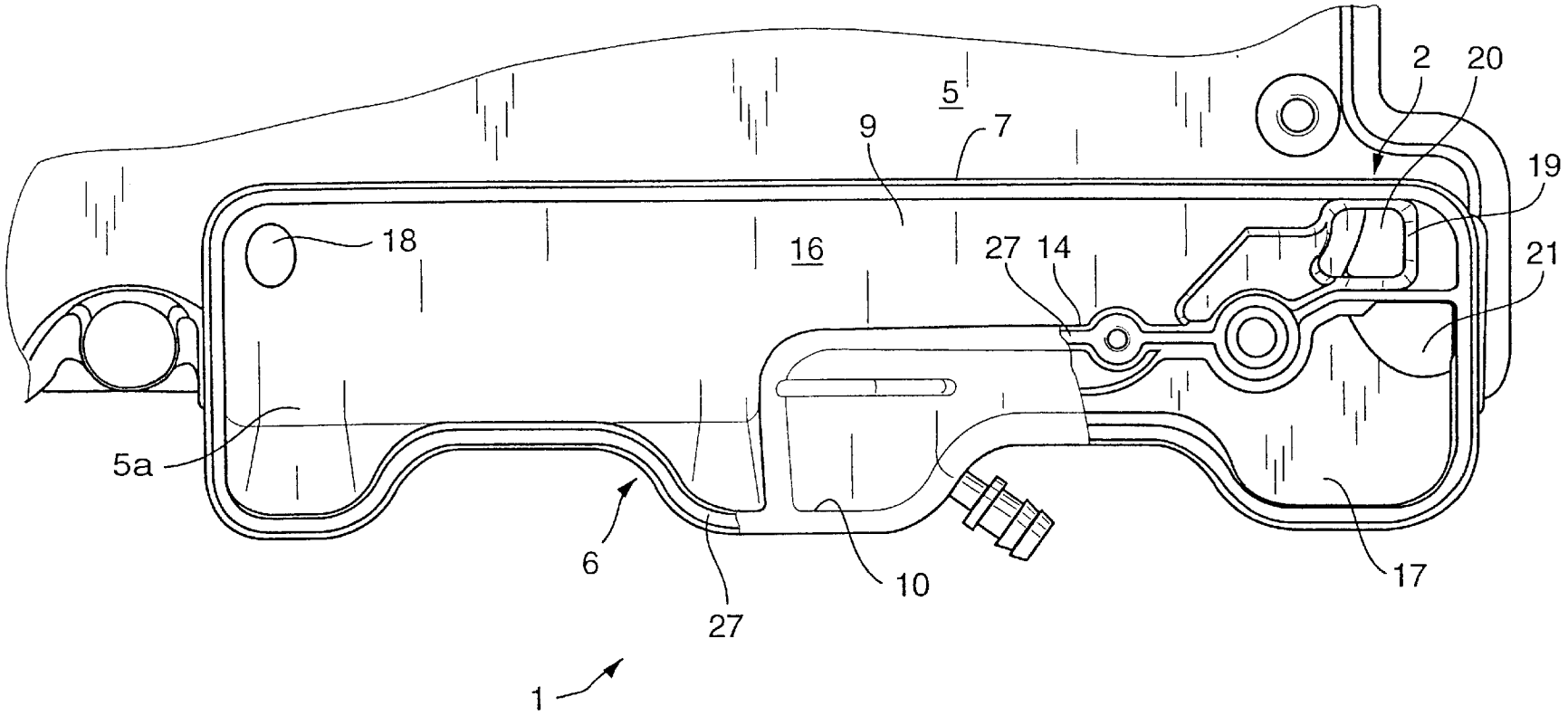
FIG. 2 is an enlarged view of the housing portion shown in FIG. 1, and partially cut open.
Figure 3:
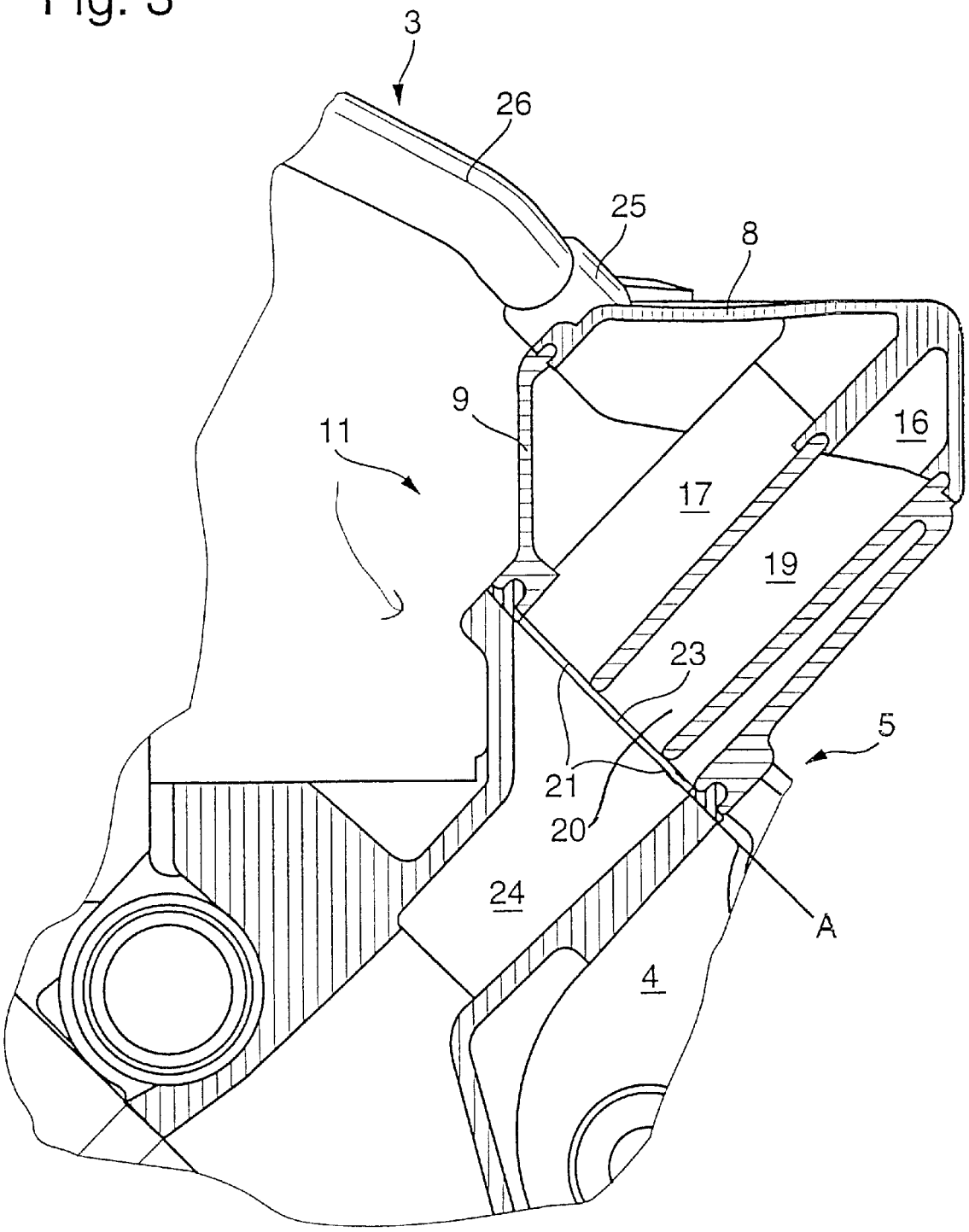
FIG. 3 is an enlarged cross-section view of an oil separatoing structure integrated into the housing.

A venting arrangement 1 (FIG. 2) with an integrated oil separator 2 for a multi-cylinder internal combustion engine 3 with cylinder banks 4 arranged in the shape of a V comprises an elongated narrow housing 6 disposed on the cylinder head cover 5. The housing 6 includes a bottom part 7 and a lid-like top part 8 (FIG. 3).

The bottom part 7 of the housing 6 is formed by the cylinderhead cover 5 (FIG. 2) and defines a housing wall 9 extending over half the length of a cylinder bank 4. The opposite housing wall portion 10 extends parallel to the housing wall 9 and is formed integrally with the cylinder head cover 5 at an area 5*a* thereof adjacent the cylinder head 11. From this area, the wall portion 10 extends upwardly and sidewardly and forms with the housing wall 9, a V shape. The front ends 12, 13 of the housing 6 are also formed integrally with the cylinder head cover 5.

As a result, the cylinder head cover 5 and the bottom part 7 of the housing 6 are a unitary structure.

The housing 6 includes a divider wall 14 between a raw gas space 16 and a purified gas space 17. To facilitate molding, the divider wall 14 is formed integrally with the lid-like top part 8 and the cylinder head cover 5 (FIG. 3). But it may also be formed solely together with the cylinder head cover 5 and extend therefrom to the lid-like top part 8.

The oil containing vent gases escaping upwardly from the crankcase are sucked into a spray-oil-free space in the cylinder head 11 and enter the raw gas space 16 by way of the inlet 18 arranged about in the longitudinal center of the cylinder head cover 5. The vent gases then flow through the raw gas space 16 up to the front end 13 of the cylinder head cover 5 and are then turned into a narrow channel 19. The narrow channel 19 has a small cross-section and extends toward the cylinder head 11 wherein the vent gases with the oil droplets contained therein are greatly accelerated.

The channel 19 has an exit opening 20 disposed in a separation plane A between the cylinder head 11 and the cylinder head cover 5. Also disposed in the separation plane A adjacent the exit opening 20 is an inlet opening 21 of relatively large cross-section (FIG. 3) providing for communication with the purified gas space 17.

Figure 4:
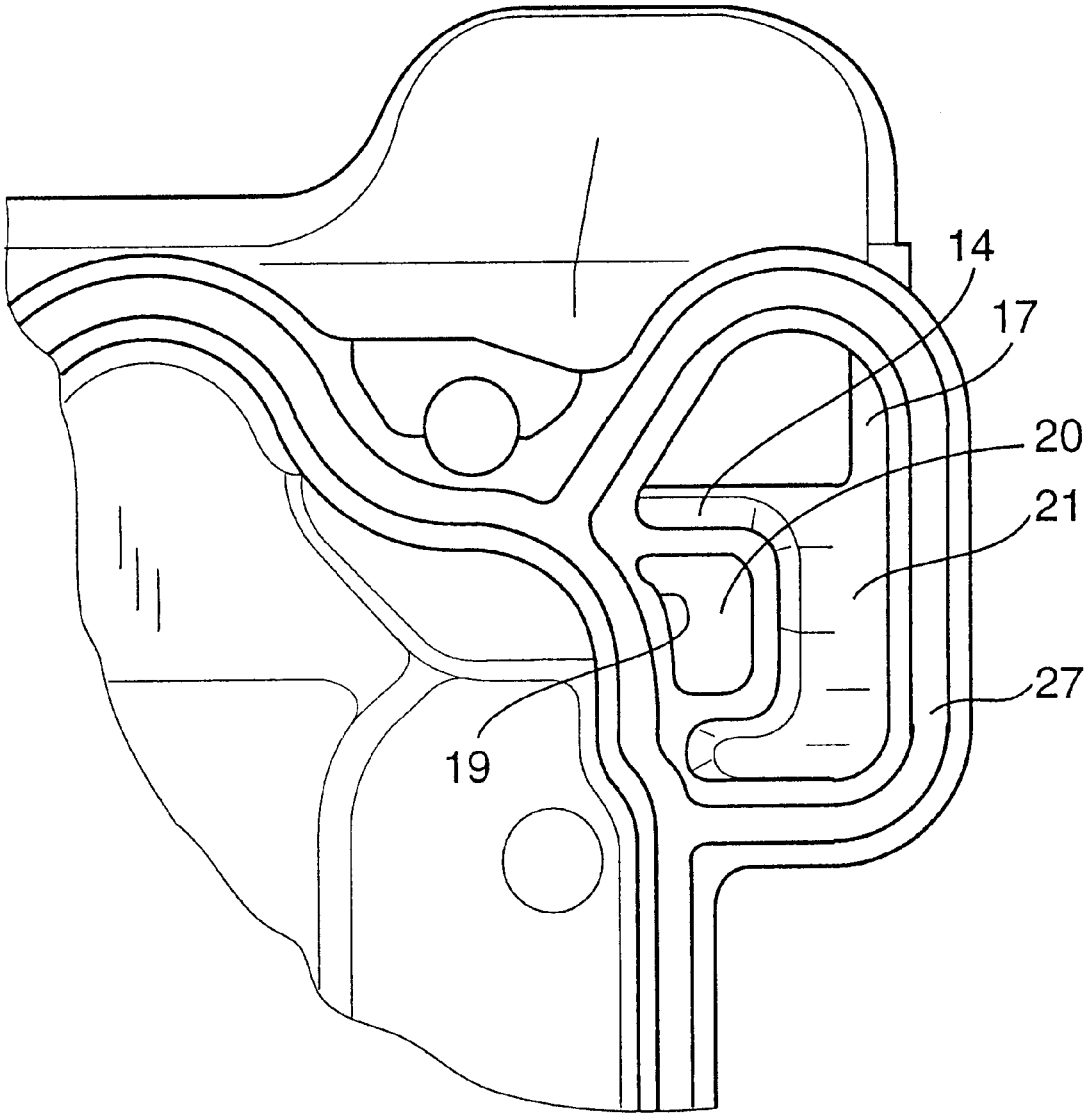
FIG. 4 shows the oil separator as seen from the underside of the cylinder head cover.

The inlet opening 21 extends around the exit opening 20 in a U-shaped fashion (FIG. 4). Both openings are disposed in a projecting part 22 at the front end of the cylinder head cover 5. Below the exit and inlet openings 20 and 21, the cylinder head 11 is provided with an inlet space 23 in which the oil droplet-containing flow of vent gases is reversed. However, because of their greater mass the oil droplets continue to move straight into the collection space 24 which is cast into the cylinder head and from which they flow back to the crankcase by way of an oil return passage which is not shown in the drawings.

After the flow reversal, the vent gases enter the purified gas space 17 by way of the inlet opening 21. The purified gas space 17 extends about to the center of the housing 6 (FIG. 1) and has, at its end opposite the inlet opening 21, a gas discharge nozzle 25 which extends from the side of the lid-like top part 8 and is connected, by way of a communication line 26, to the intake duct of the internal combustion engine (not detailed).

Figure 1:
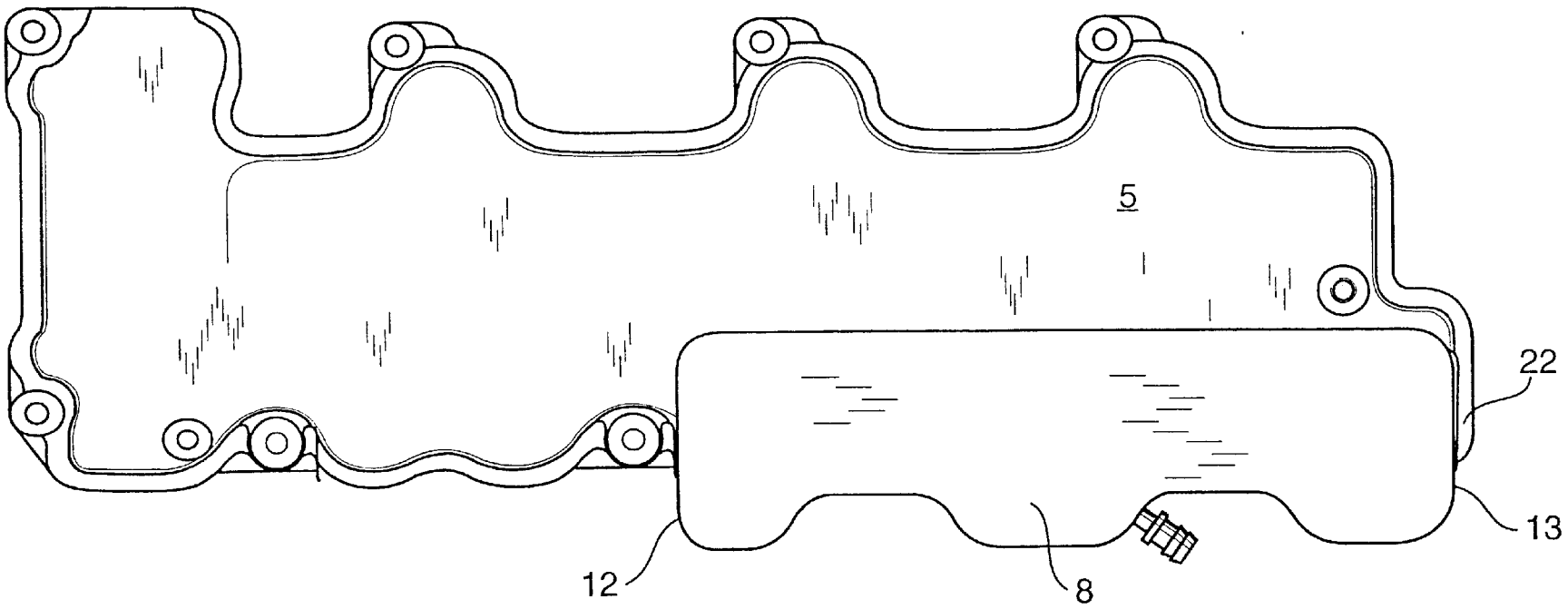
FIG. 1 is top view of a cylinder head cover including a housing portion receiving the vent gases.

The top part 8 which is provided in the form of a lid which is screwed onto the cylinder head cover 5 and is sealed to the housing 6 by way of a silicon-filled groove and tongue joint 27 which extends also over the full length of the divider wall halves (FIGS. 1, 3, 4).

What is claimed is:

1. A venting arrangement with integrated oil separator for venting gases from a crank case of an internal combustion engine having a cylinder head with a cylinder head cover including a housing with a bottom part and a lid-like top part and an inlet for receiving oil droplet-containing vent gases from said crankcase and a gas outlet for venting oil droplet-free gases from said housing to an engine intake duct, said bottom part of said housing being part of said cylinder head cover and including a divider wall dividing said housing into a raw gas space having an exit opening directed toward said cylinder head and a purified gas space having an inlet opening disposed adjacent said exit opening of said raw gas space, said cylinder head having, adjacent said exit and inlet openings, an inlet space in which the flow direction of the vent gases flowing from said exit opening to said inlet opening is reversed whereby oil droplets are released from said vent gases and collected in said inlet space for returning them to said crankcase.

2. A venting arrangement according to claim 1, wherein said raw gas space exit opening and purified gas space inlet opening are disposed in a separating plane between said cylinder head and said cylinder head cover and said inlet space has an opening disposed in said separating plane and covering both said exit and said inlet openings.

3. A venting arrangement according to claim 1, wherein, adjacent said exit opening, said raw gas space forms a downwardly directed channel of a relatively small cross-section leading to said exit opening and said inlet opening has a relatively large cross-section such that the vent gases including oil droplets enter the collection space at relatively high speed but, after reversal and separation of said oil droplets, leave said collection space at relatively low speed.

4. A venting arrangement according to claim 2, wherein, in the area of said separating plane, said inlet opening extends partially around said exit opening in a U-shaped fashion.

5. A venting arrangement according to claim 2, wherein said divider wall delimiting on one side said raw gas space and at the other side said purified gas space is formed integrally with the front wall of said cylinder head cover.

6. A venting arrangement according to claim 1, wherein said housing top part is a lid screwed onto the housing bottom part and sealed thereto by a groove and tongue joint filled with silicon.

7. A venting arrangement according to claim 1, wherein said housing receiving said vent gases extends over about half the length of the cylinder head cover of a cylinder bank and has a vent gas inlet disposed about in the middle of the longitudinal extension of said cylinder head cover.

* * * * *